US008517629B2

(12) United States Patent
Gregerson

(10) Patent No.: US 8,517,629 B2
(45) Date of Patent: Aug. 27, 2013

(54) POTHOLE REPAIR SYSTEM

(76) Inventor: Dennis J. Gregerson, Waubay, SD (US)

( * ) Notice: Subject to any disclaimer, the term of this patent is extended or adjusted under 35 U.S.C. 154(b) by 243 days.

(21) Appl. No.: 12/783,117

(22) Filed: May 19, 2010

(65) Prior Publication Data

US 2011/0085860 A1 Apr. 14, 2011

Related U.S. Application Data

(60) Provisional application No. 61/250,296, filed on Oct. 9, 2009.

(51) Int. Cl.
*E01C 19/18* (2006.01)

(52) U.S. Cl.
USPC ..... 404/110; 404/108

(58) Field of Classification Search
USPC ..... 404/101, 108, 110, 80, 81
See application file for complete search history.

(56) References Cited

U.S. PATENT DOCUMENTS

| | | | | | |
|---|---|---|---|---|---|
| 2,659,583 | A | * | 11/1953 | Dorkins | 173/28 |
| 2,888,246 | A | * | 5/1959 | Sieber | 173/98 |
| 3,259,035 | A | * | 7/1966 | Pfundt | 404/133.1 |
| 3,376,799 | A | * | 4/1968 | Perry et al. | 404/133.2 |
| 4,005,944 | A | * | 2/1977 | Harris | 404/133.2 |
| 4,055,255 | A | * | 10/1977 | Vasquez | 414/21 |
| 4,557,626 | A | * | 12/1985 | McKay et al. | 404/90 |
| 4,676,689 | A | * | 6/1987 | Yant | 404/110 |
| 4,765,772 | A | * | 8/1988 | Benedetti et al. | 404/77 |
| 4,830,533 | A | * | 5/1989 | Miller | 404/101 |
| 5,234,282 | A | | 8/1993 | Osborn | |
| 5,236,275 | A | * | 8/1993 | Kneeland et al. | 404/75 |
| 5,269,626 | A | * | 12/1993 | Soliman et al. | 404/108 |
| 5,490,740 | A | | 2/1996 | Johnson | |
| 5,662,385 | A | * | 9/1997 | Bishop | 299/37.3 |
| 6,325,459 | B1 | | 12/2001 | Jaeger | |
| 6,520,592 | B1 | | 2/2003 | Bobholz | |
| 6,619,882 | B2 | | 9/2003 | Harvey | |
| 7,481,601 | B2 | * | 1/2009 | Gilchrist | 404/109 |
| 2006/0021292 | A1 | | 2/2006 | Norton | |
| 2006/0198701 | A1 | | 9/2006 | Hall | |
| 2008/0279628 | A1 | | 11/2008 | Mailand | |

* cited by examiner

*Primary Examiner* — Thomas B Will
*Assistant Examiner* — Abigail A Risic
(74) *Attorney, Agent, or Firm* — Neustel Law Offices

(57) ABSTRACT

A pothole repair system for completely repairing potholes through the operation of a loader vehicle and connected implement. The implement generally includes a supporting structure adapted to mount to the loader, such as a skid steer loader or excavator, a hopper-style bucket connected to the supporting structure, the bucket having a lower opening closable by an actuated gate, a first impact device connected to the supporting structure to engage a road surface in a reciprocating manner, wherein first impact device has an interchangeable tamper end, a second impact device connected to the supporting structure to engage a road surface in a reciprocating manner, wherein the second impact device has an interchangeable chisel end. The impact devices may be raised and lowered via linkage assemblies or may be fixed to the supporting structure. Other tools, such as air nozzles may be used to assist in repairing the potholes.

1 Claim, 14 Drawing Sheets

POTHOLE REPAIR SYSTEM

CROSS REFERENCE TO RELATED APPLICATIONS

I hereby claim benefit under Title 35, United States Code, Section 119(e) of U.S. provisional patent application Ser. No. 61/250,296 filed Oct. 9, 2009. The 61/250,296 application is currently pending. The 61/250,296 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a road resurfacing system and more specifically it relates to a pothole repair system for completely repairing potholes through the operation of a loader vehicle and connected implement.

2. Description of the Related Art

Any discussion of the related art throughout the specification should in no way be considered as an admission that such related art is widely known or forms part of common general knowledge in the field.

Potholes are commonplace in various asphalt and concrete surfaces. Potholes can not only cause damage to passing vehicles, but can also cause loss of control of the vehicle and are generally unsightly. To fix potholes, construction workers must generally be present upon the road surfaces to perform manual labor upon the potholes for repair. Because of passing traffic, this can often times be very dangerous for the construction workers.

The risk associated with performing manual labor along side of passing traffic can also prevent many construction workers from willingly accepting jobs that require pothole repair which leads to delays in many potholes not being repaired and/or potholes being repaired in an unsatisfactory manner because the construction worker desires to remove him or herself from the danger of working near passing traffic as soon as possible. Because of the inherent problems with the related art, there is a need for a new and improved pothole repair system for completely repairing potholes through the operation of a loader vehicle and connected implement.

BRIEF SUMMARY OF THE INVENTION

A system for completely repairing potholes through the operation of a loader vehicle and connected implement. The invention generally relates to a road resurfacing system which includes an implement having a supporting structure adapted to mount to the loader, such as a skid steer loader or excavator, a hopper-style bucket connected to the supporting structure, the bucket having a lower opening closable by an actuated gate, a first impact device connected to the supporting structure to engage a road surface in a reciprocating manner, wherein first impact device has an interchangeable tamper end, a second impact device connected to the supporting structure to engage a road surface in a reciprocating manner, wherein the second impact device has an interchangeable chisel end. The impact devices may be raised and lowered via linkage assemblies or may be fixed to the supporting structure. Other tools, such as air nozzles may be used to assist in repairing the potholes.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
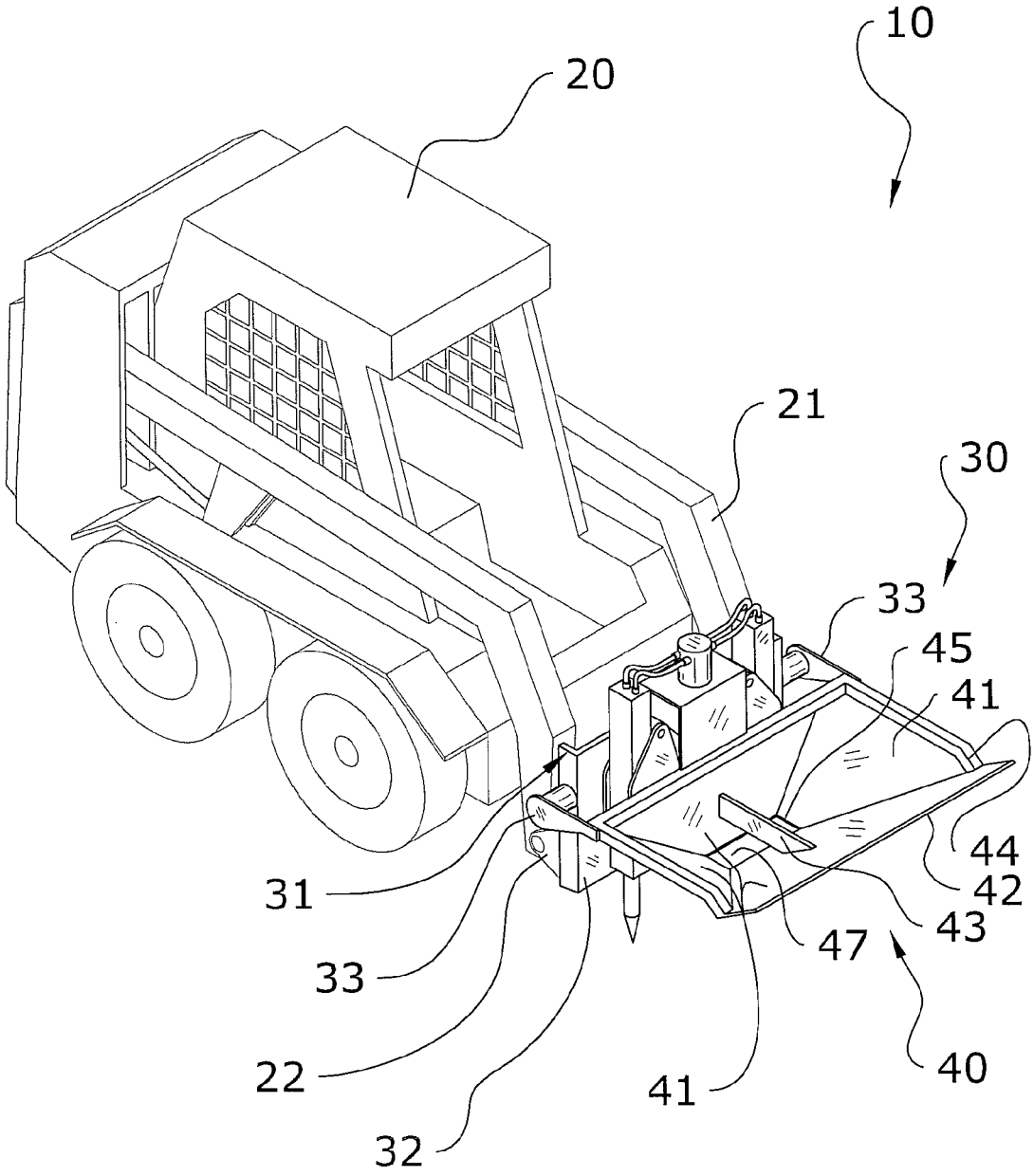
FIG. 1 is an upper perspective view of the first embodiment of the present invention attached to a skid steer loader.
Figure 2:
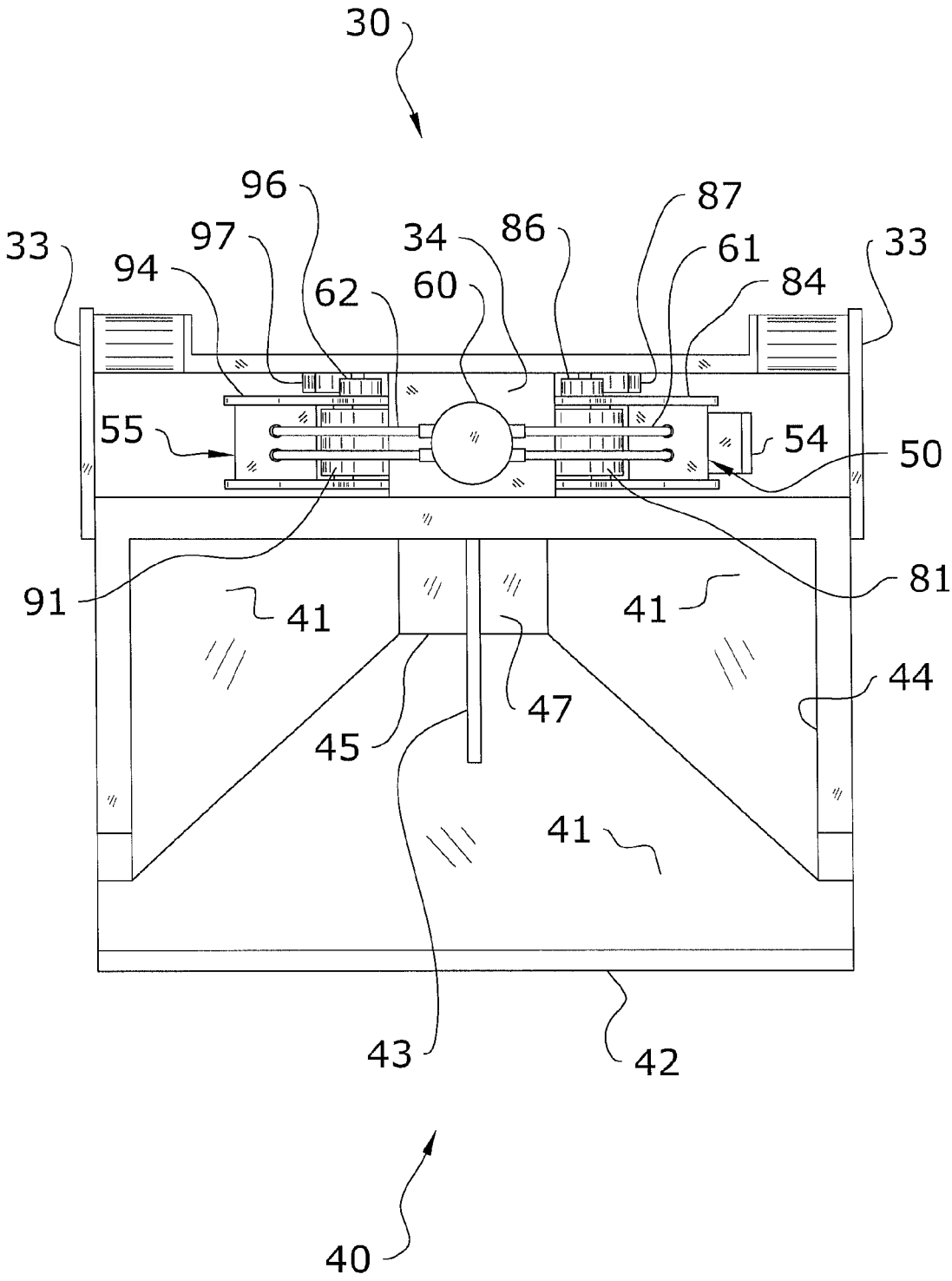
FIG. 2 is a top view of the first embodiment.
Figure 3:
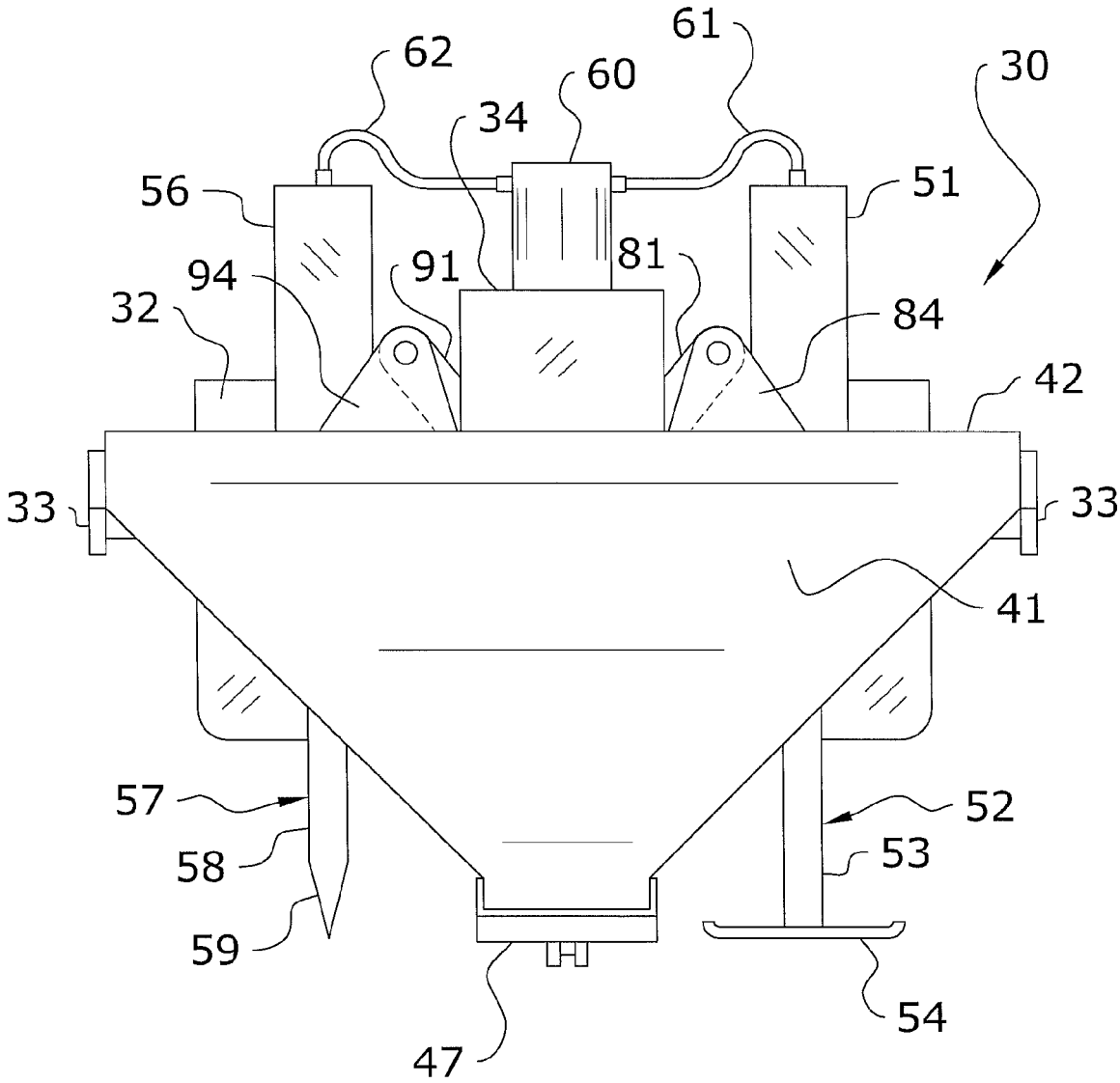
FIG. 3 is a front view of the first embodiment.
Figure 4:
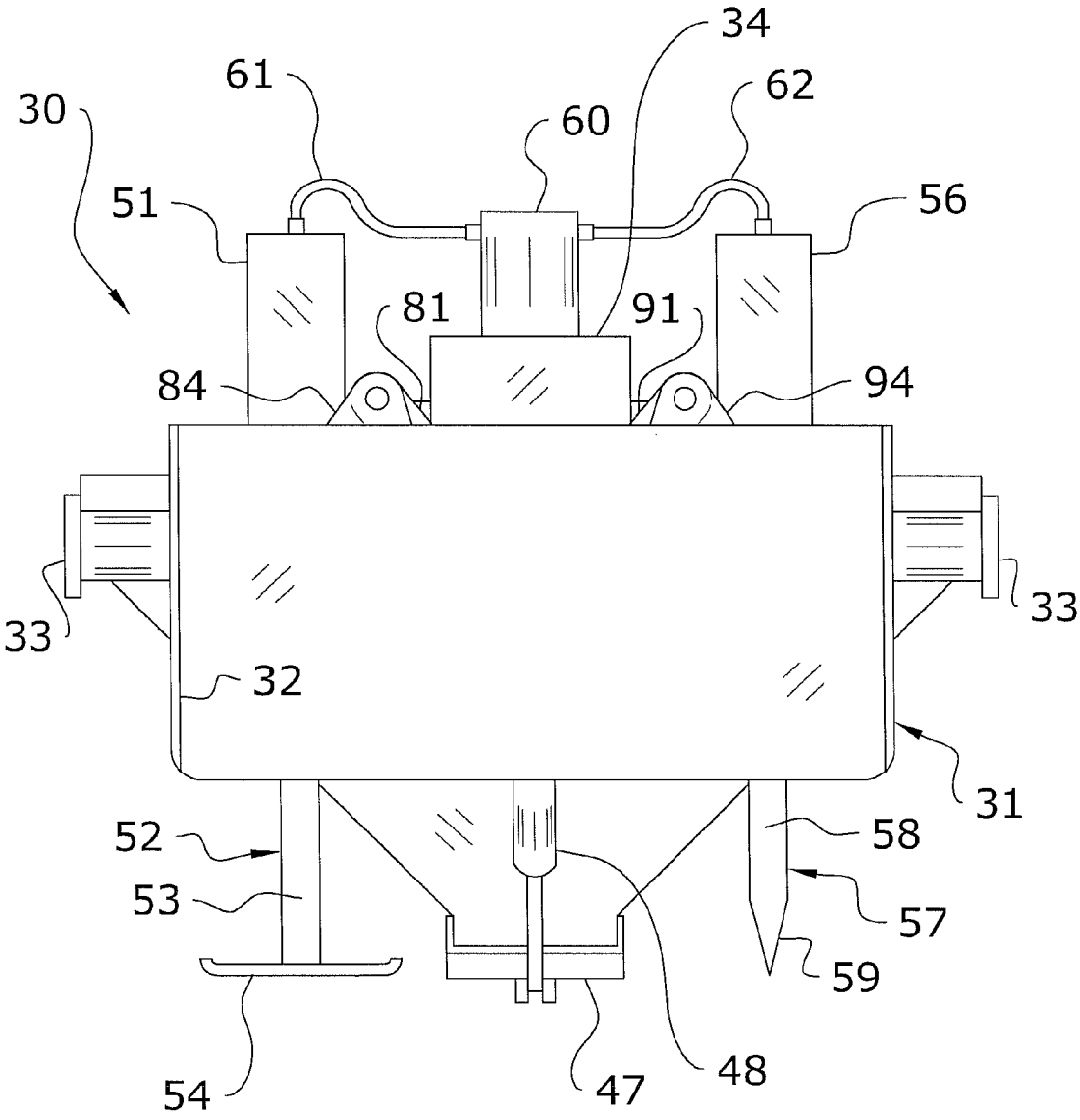
FIG. 4 is a rear view of the first embodiment.
Figure 5:
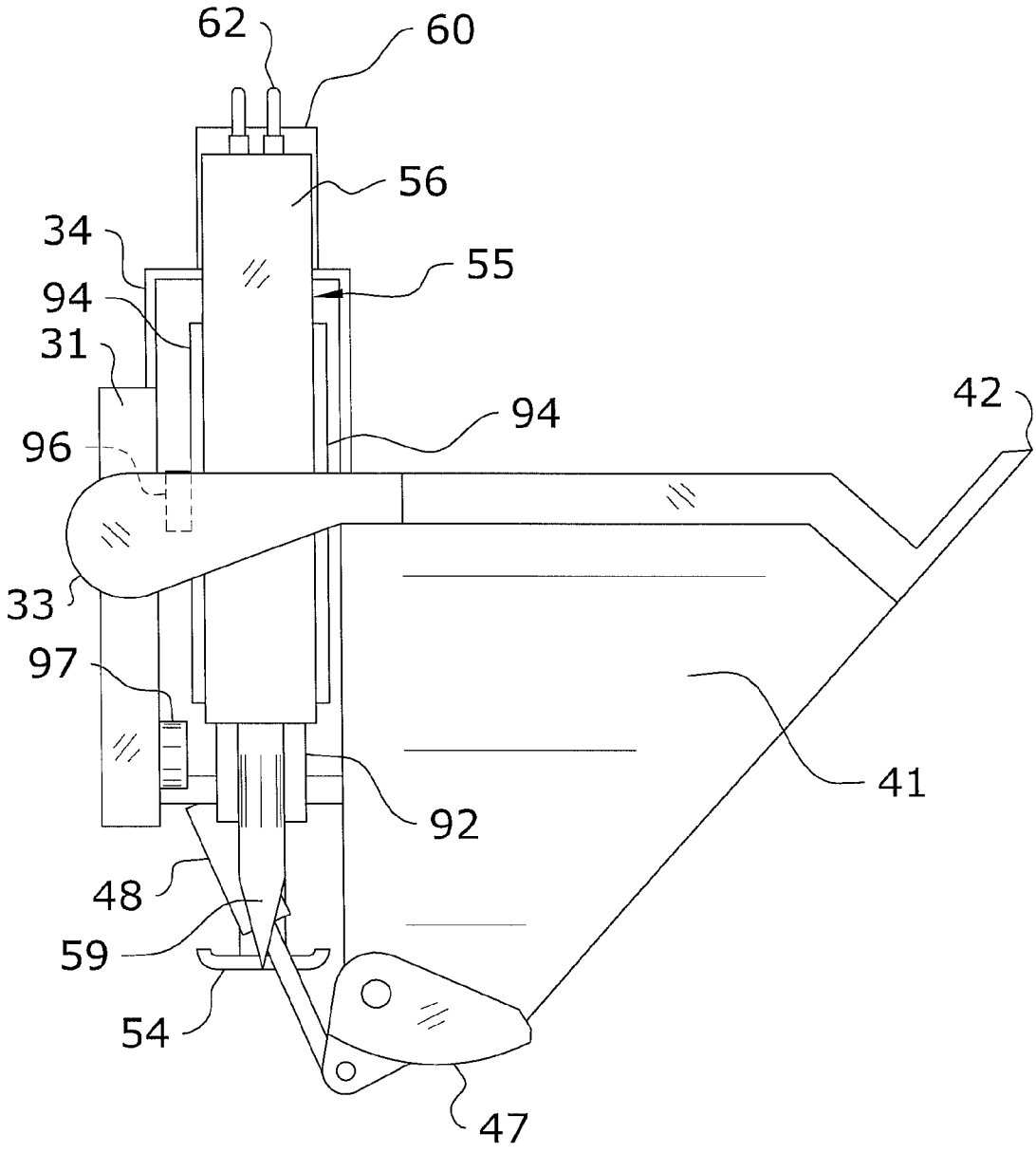
FIG. 5 is a first side view of the first embodiment.
Figure 6:
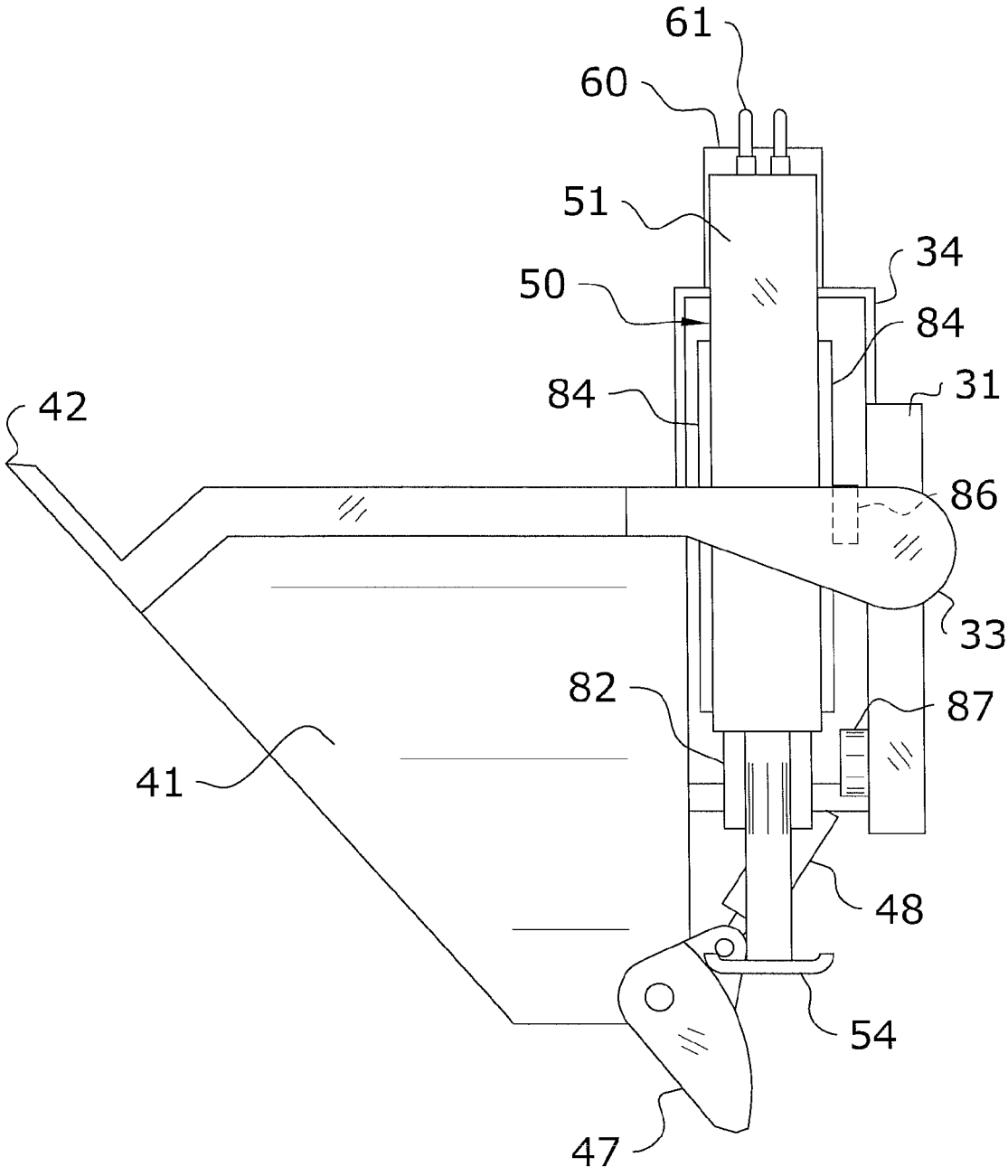
FIG. 6 is a second side view of the first embodiment.

A. Overview.

Turning now descriptively to the drawings, in which similar reference characters denote similar elements throughout the several views, FIGS. 1 through 13 illustrate a pothole repair system 10, which comprises an implement 30 having a supporting structure 31 adapted to mount 32 to the loader 20, such as a skid steer loader or excavator, a hopper-style bucket 40 connected to the supporting structure 31, the bucket 40 having a lower opening 45 closable by an actuated gate 47, a first impact device 50 connected to the supporting structure 31 to engage a road surface in a reciprocating manner, wherein first impact device 50 has an interchangeable tamper end 54, a second impact device 55 connected to the supporting structure 31 to engage a road surface in a reciprocating manner, wherein the second impact device 55 has an interchangeable chisel end 59. The impact devices 50, 55 may be raised and lowered via linkage assemblies 80, 90 or may be fixed to the supporting structure 31. Other tools, such as air nozzles 100 may be used to assist in repairing the potholes 11. Road surface may refer to any type of road, parking lot, driveway, etc.

Figure 12:
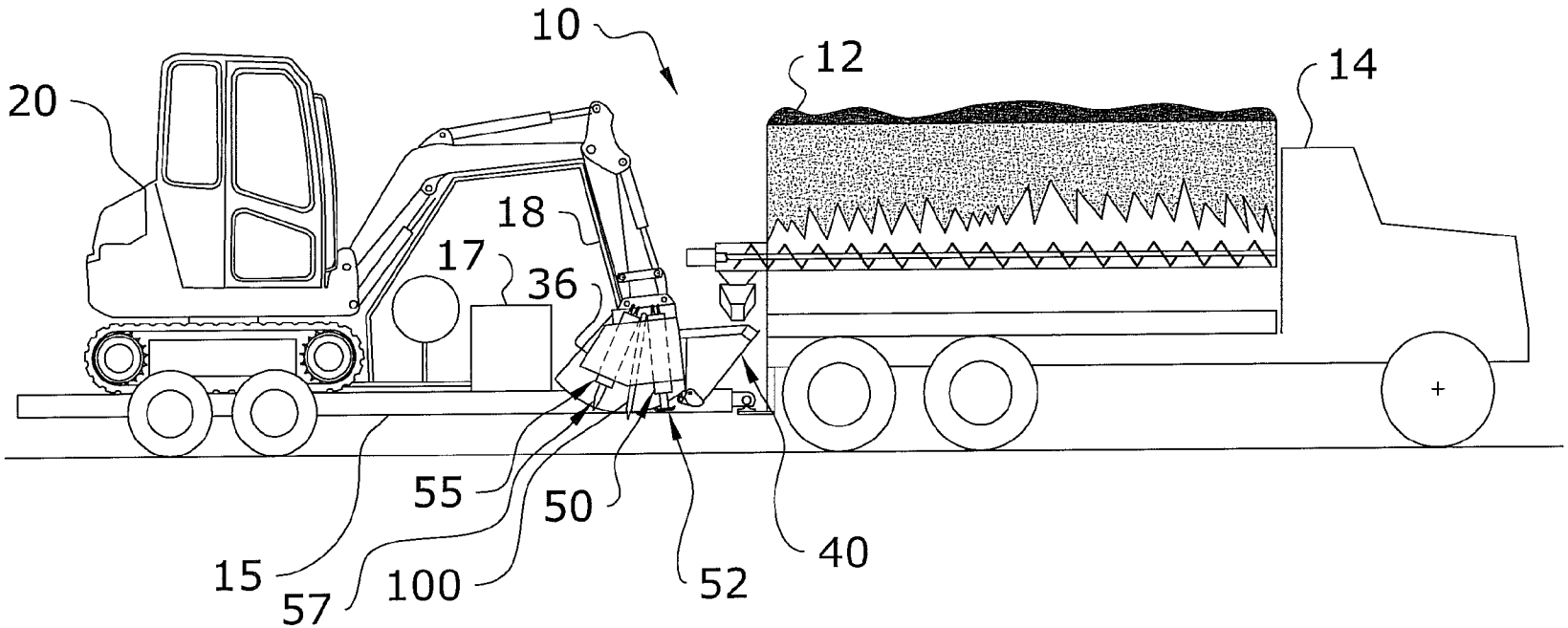
FIG. 12 is a side view of the second embodiment of the present invention attached to an excavator with the excavator receiving the fill material from a truck while positioned on a trailer.
Figure 13:
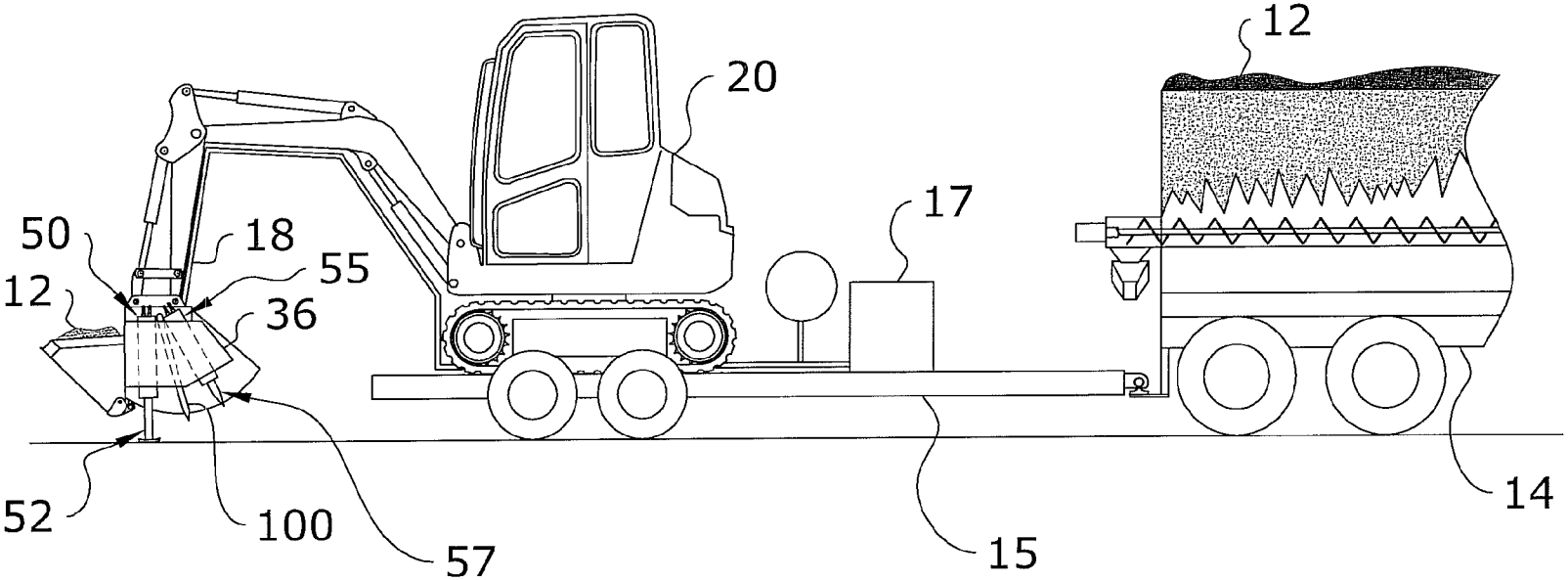
FIG. 13 is a side view of the second embodiment attached to an excavator with the excavator working on the pothole while positioned on the trailer.

Various types of loaders 20 may be used with the implement 30 to maneuver the implement 30 when repairing the road surface. Examples of loaders 20 include a skid steer loader as illustrated in FIGS. 11*a* through 11*d*, an excavator as illustrated in FIGS. 12 and 13, or various others. It is appreciated that the stationary structures may also be used rather than a loader 20. In the preferred embodiment, the loader arms 21 maneuver the implement 30 via an actuator(s), etc. onboard the loader 20. The loader 20 also generally includes a quick attach structure or other type of attachment 22 for easily and quickly securing the implement 30 to the loader 20.

The implement 30 is generally used to repair road surfaces, such as but not limited to potholes 11 in asphalt, concrete, etc. without necessitating the operator of the loader 20 to dismount or leave the loader 20, wherein the implement 30 includes all necessary tools completely repairs the pothole 11 in the road surface. The implement 30 generally includes multiple tools each used for a specified purpose.

For example, the implement 30 preferably includes a bucket 40 used to scoop fill material 12 and distribute the fill material 12 within the pothole 11. The implement 30 also generally includes a first impact device 50 having a tampering end 54 for compacting the fill material 12 and leveling the pothole 11 and a second impact device 55 having a chiseling end 59 for breaking apart the pothole 11 to evenly distribute the fill material 12.

It is appreciated that the working ends 54, 59 of the impact devices 50, 55 may be simultaneously attached to the implement 30 or may be interchangeably attached to the implement 30. The implement 30 may include one or both impact devices 50, 55, or may include additional impact or working devices. The implement 30 also may include an air nozzle 100 for cleaning or spraying the pothole 11 or repaired road surface. It is also appreciated that the implement 30 may include its own power supply or may use the power supply of the loader 20 or other machinery.

B. Supporting Structure.

The implement 30 includes a supporting structure 31 that is used to attach to the arm(s) 21 of the loader 20 and directly or indirectly connect and support the bucket 40, impact devices 50, 55, and supporting framework. The supporting structure 31 generally includes a mount 32 that connects to the attachment 22 of the loader 20. The mount 32 may attach to the attachment 22 of the loader 20 in various manners common with implements 30, such as a quick attach manner, fasteners, etc. The support assembly 31 is generally comprised of a rigid and strong material, such as but not limited to metal.

In a first embodiment, as illustrated in FIGS. 1 through 9, the supporting structure 31 has a pair of side supports 33 extending from each lateral end of the mount 32 outwards and forwards for securing the top end of the bucket 40 thereto. The side supports 33 forwardly space the rear of the bucket 40 from the front of the mount 32 to allot space for the impact devices 50, 55 and linkage assembly 80, 90 between thereof. The supporting structure 31 may also include a raised platform support 34 for the valve/pump 60.

In a second embodiment, as illustrated in FIGS. 12 and 13, the supporting structure 31 includes a pair of support plates 36 connecting the mount 32 to the rear of the bucket 40. The support plates 36 are generally adjacent a cross-wise center of the bucket 40 and are laterally spaced apart to allot space for the impact devices 50, 55 between thereof. It is appreciated that the support assembly 31 may include various other structures, members, plates, etc. to ensure that the bucket 40, impact devices 50, 55, and associated connecting assemblies are able to be securely mounted thereto.

C. Bucket.

The bucket 40 is secured to the front side of the supporting structure 31. The bucket 40 may be fixedly attached to the supporting structure 31 or removably attached. The bucket 40 is generally comprised of a hopper-style bucket to have an upper opening 44 for filling and a closable lower opening 45 for dumping. The bucket 40 is generally comprised of a rigid and strong material, such as but not limited to metal. The bucket 40 is also able to be rotated, via rotating the supporting structure 31 as is conventional with loader buckets.

The bucket 40 includes sidewalls 41 defining an internal cavity for receiving the fill material 12 through a defined upper opening 44 and the lower opening 45 for emptying the internal cavity of the fill material 12. The sidewalls 41 generally taper inwards from the upper opening 44 to the lower opening 45 of the bucket 40 to ensure that all fill material 12 exits through the lower opening 45. The lower opening 45 is also generally substantially smaller in size than the upper opening 44 to more precisely direct the fill material 12 into the pothole 11. The front edge 42 of the bucket 40 preferably extends forwardly outwards for digging and scooping fill material 12. The front edge 42 may be used as a cutting edge to level the fill material 14 after filling the pothole 12.

The bucket 40 may also include a divider 43 located within the internal cavity and connected to the interior surface of opposing sidewalls 41 to direct the fill material 12 properly through the lower opening 45. The divider 43 is generally positioned adjacent and above the lower opening 45.

The bucket 40 includes a pivotal gate 47 at a lower end for selectively opening and closing the lower opening 45 to prevent and allow fill material 12 to exit therethrough. The gate 47 is generally pivoted by an actuator 48, such as a hydraulic cylinder, powered by the loader 20 and operated via controls of the loader 20. The gate 47 is generally curved to match the shape of the lower end of the bucket 40.

D. Impact Devices.

Figure 7:
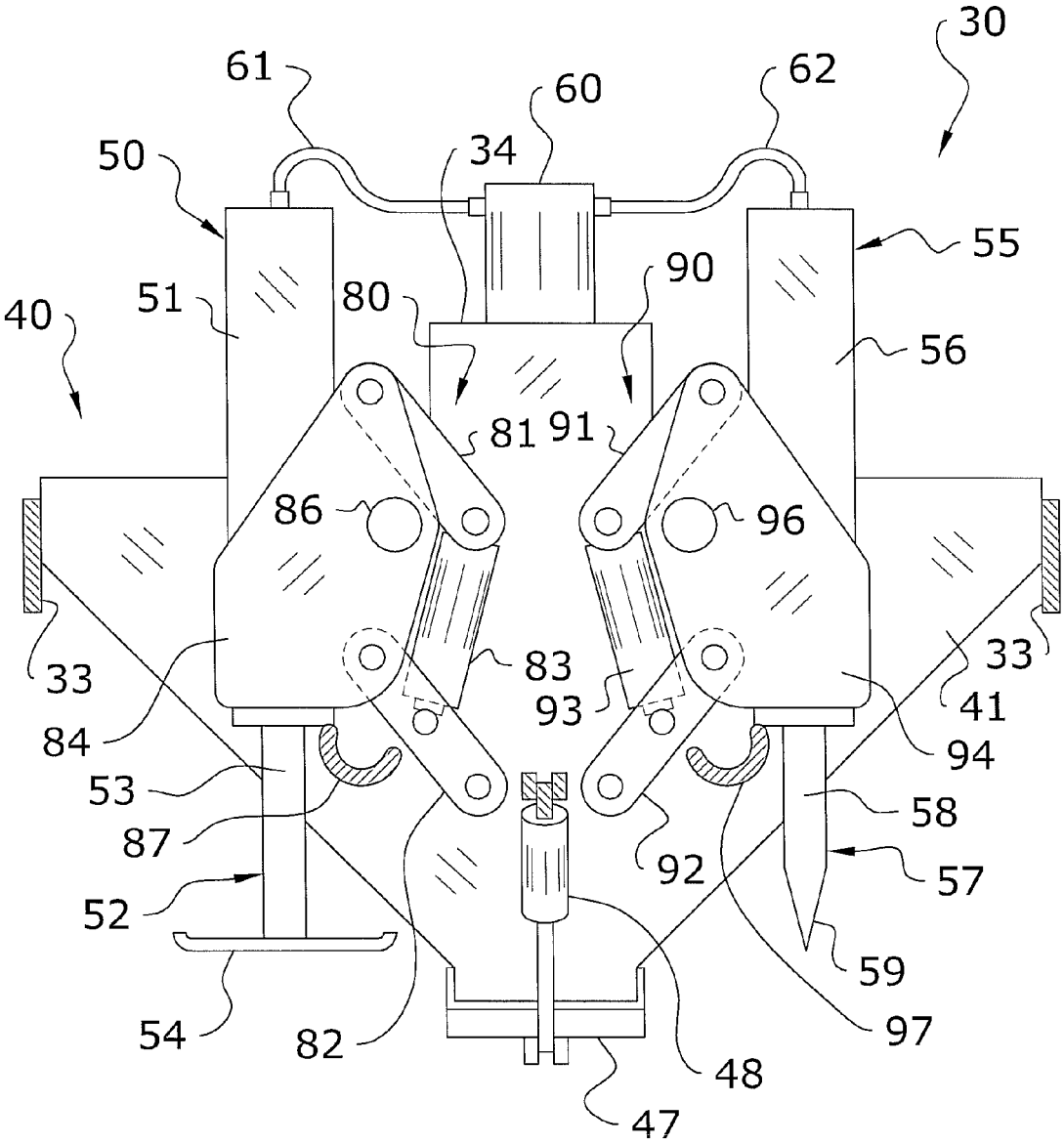
FIG. 7 is a rear view of the impact devices and linkage assemblies of the first embodiment with the impact devices both in the raised position.
Figure 8:
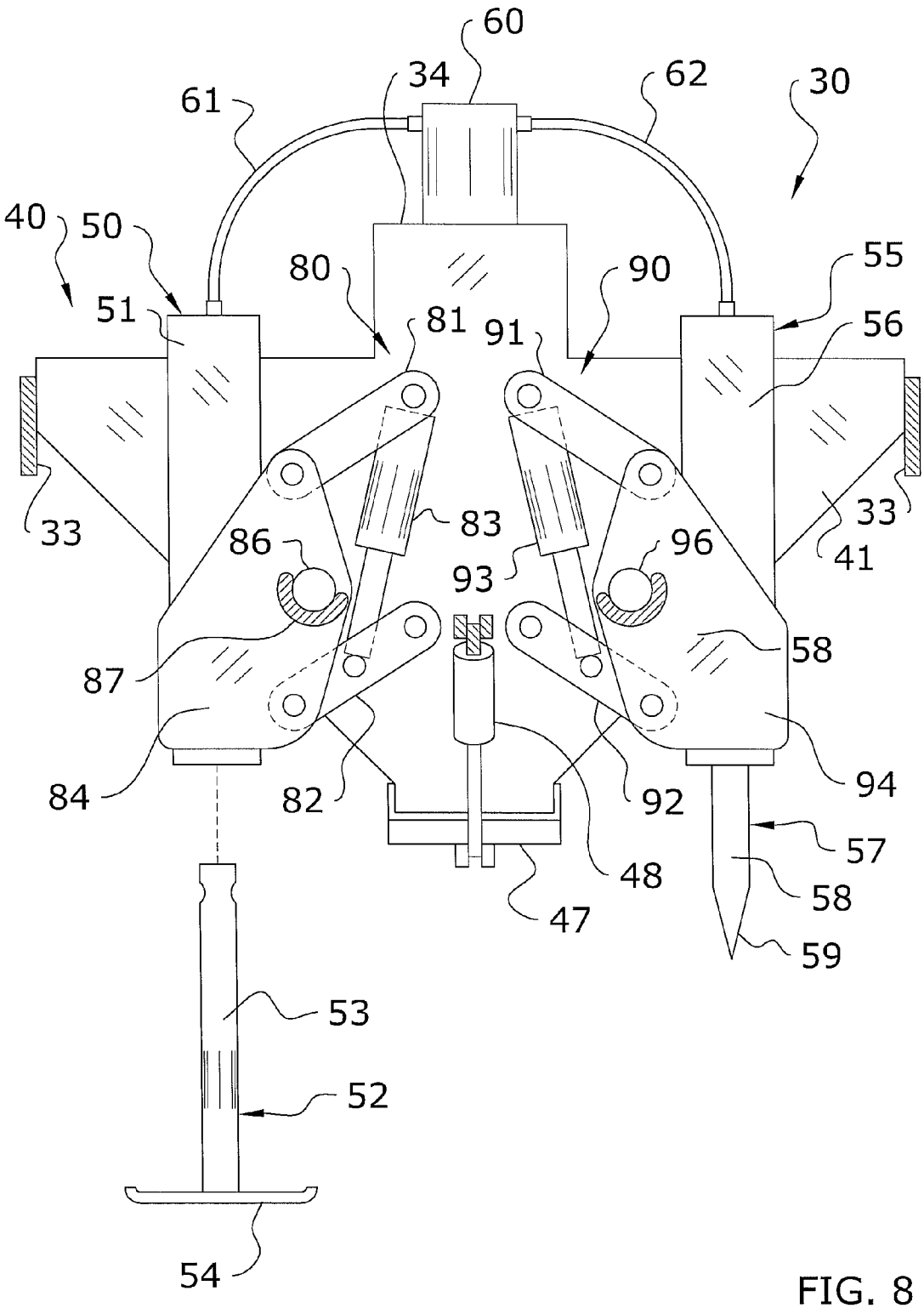
FIG. 8 is a rear view of the impact devices and linkage assemblies of the first embodiment with the impact devices both in the lowered position and the first tool being removed.
Figure 9:
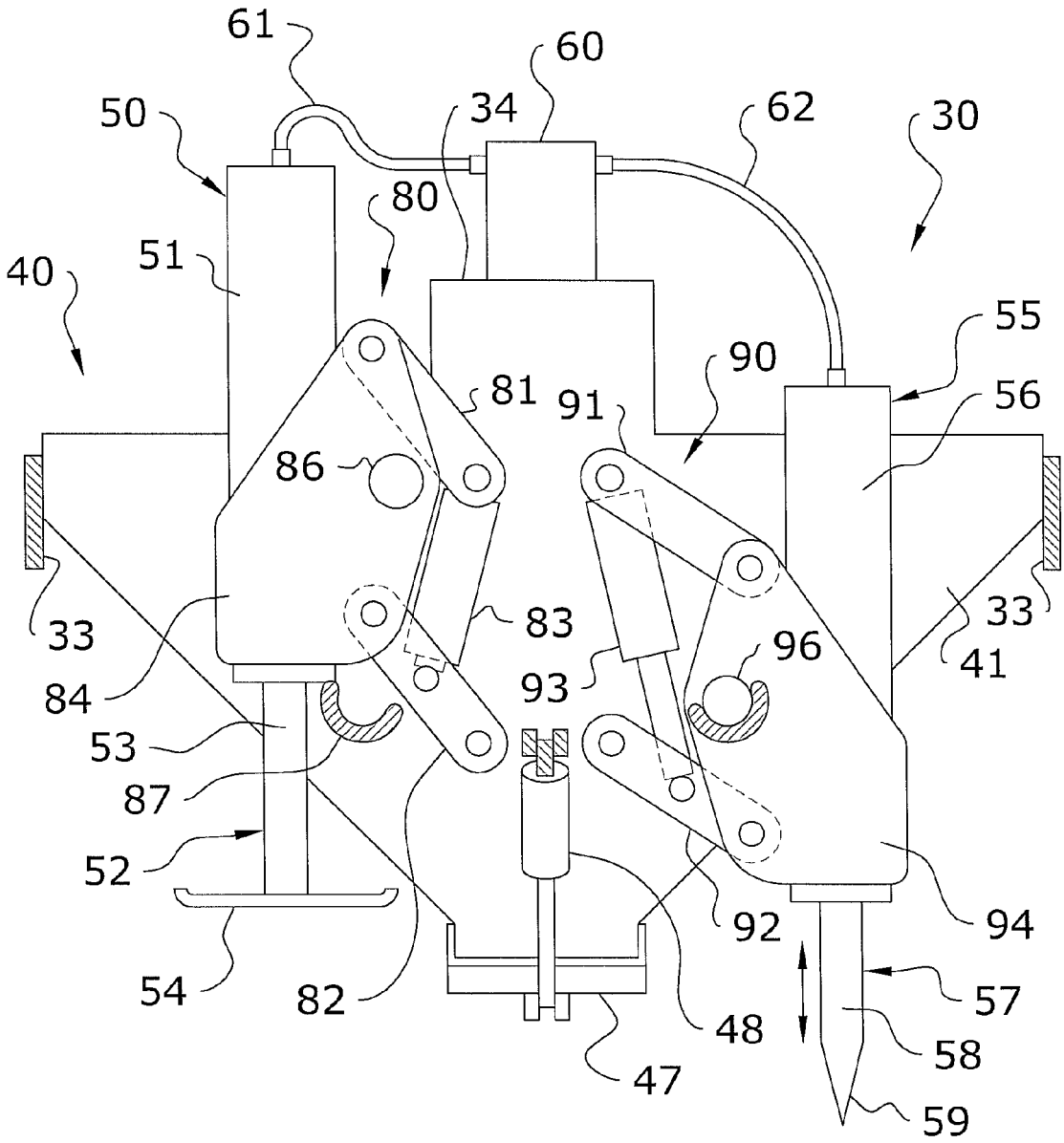
FIG. 9 is a rear view of the impact devices and linkage assemblies of the first embodiment with the first impact device in the raised position and the second impact device reciprocating in the lowered position.
Figure 10:
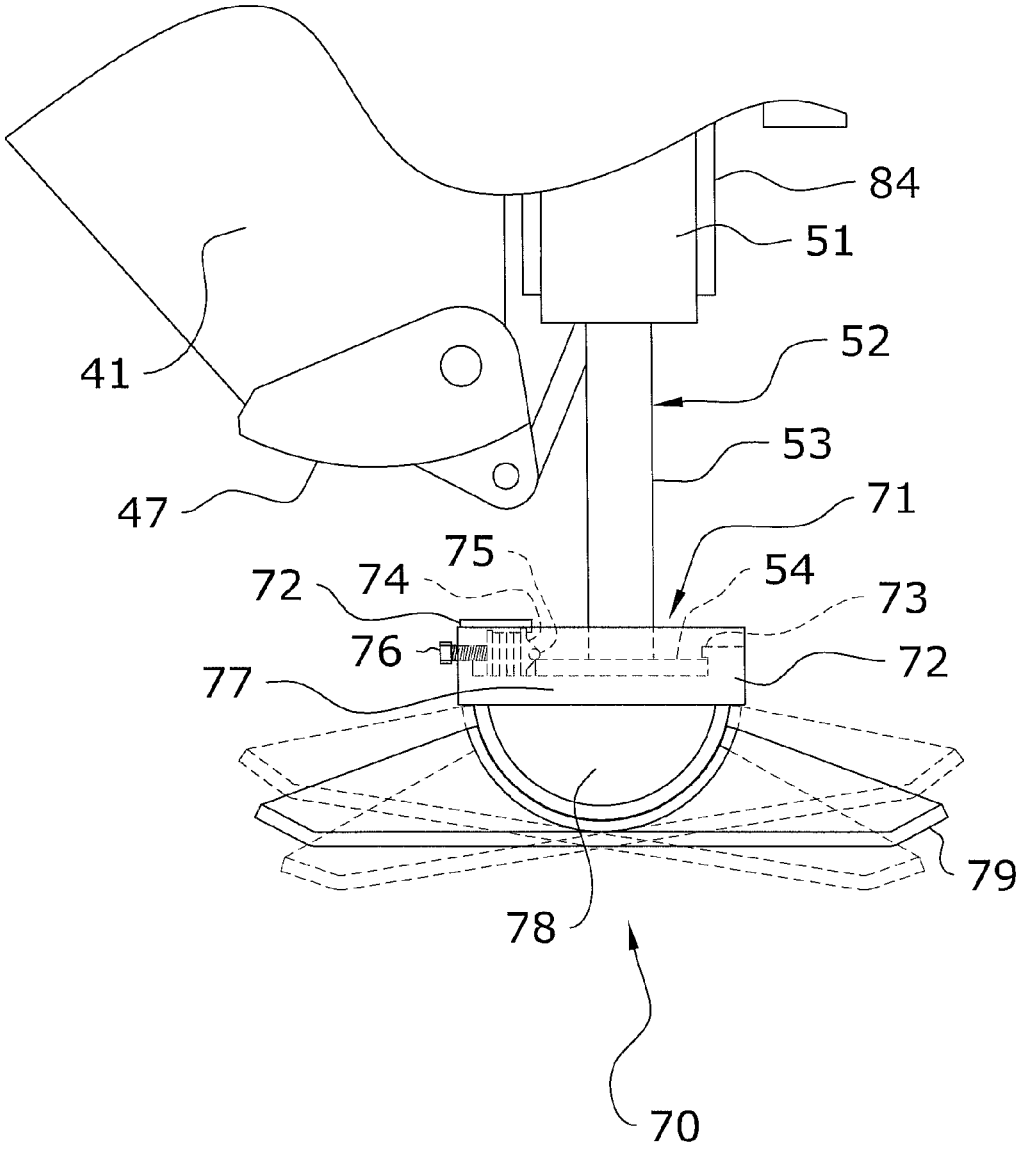
FIG. 10 is a side view of the shoe attached to the first tool illustrating the shoe freely pivoting.
Figure 11A:
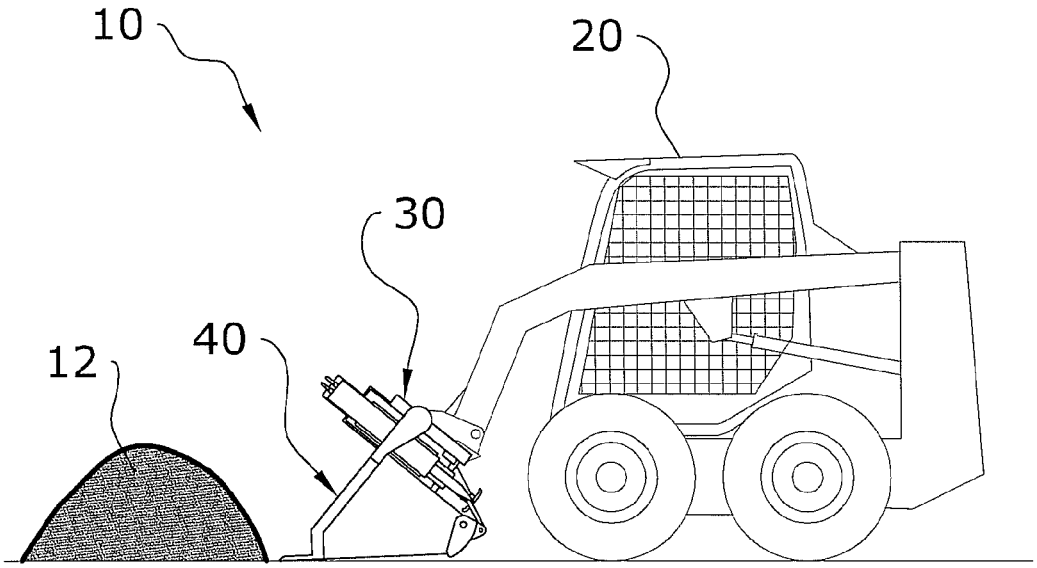
FIG. 11*a* is a side view of the first embodiment in use when scooping the fill material within the bucket.
Figure 11B:
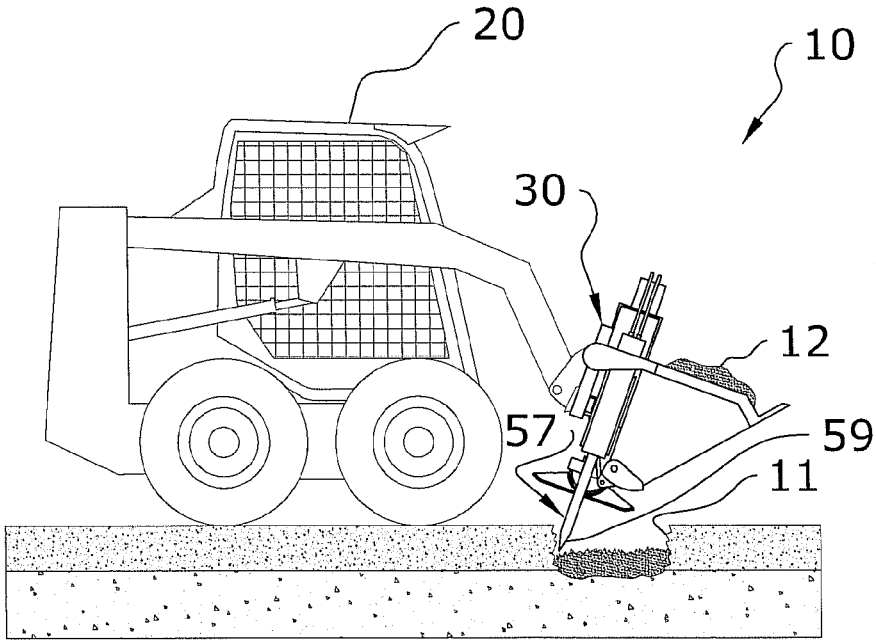
FIG. 11*b* is a side view of the first embodiment in use with the second tool being used to square the pothole.
Figure 11C:
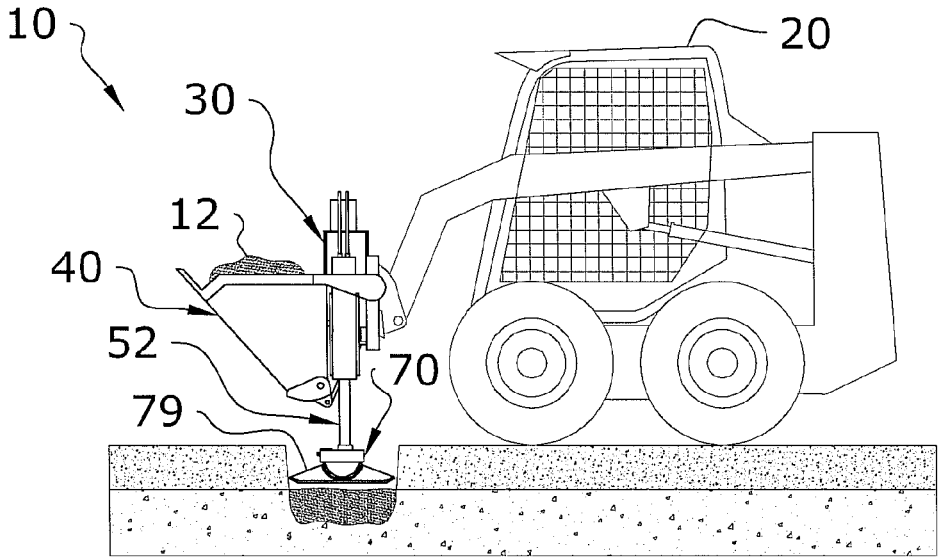
FIG. 11*c* is a side view of the first embodiment in use with the first tool aligned with a pothole and being used to compact the fill material.
Figure 11D:
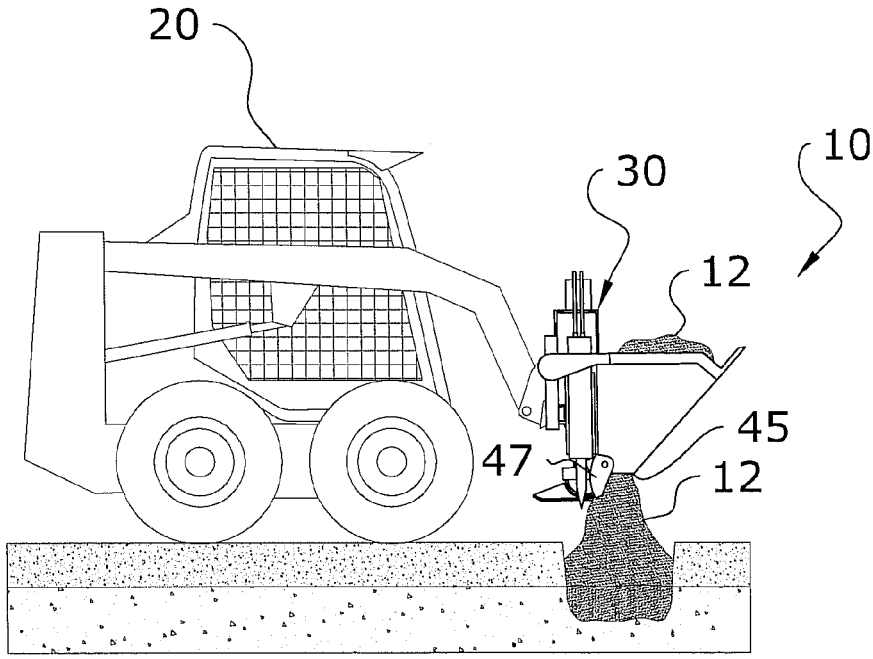
FIG. 11*d* is a side view of the first embodiment in use with the fill material being emptied from the bucket into the pothole through the lower opening of the bucket.

The present invention generally includes at least two reciprocating impact devices 50, 55 for impacting the road surface and/or pothole 11 to repair the pothole 11. The impact devices 50, 55, as a whole, may be movable with respect to the bucket 40 such as being moved from an in-use (i.e. lowered) to a non-use (i.e. raised) position or the impact devices 50, 55 as illustrated in FIGS. 7 through 9 or may be fixed to the bucket 40 as illustrated in FIGS. 12 and 13, wherein to use either impact device 50, 55, the bucket 40 is simply lowered and/or pivoted.

The impact devices 50, 55 generally comprise a first impact device 50 being used for compacting road surfaces and fill material 12 and a second impact device 55 being used for breaking apart road surfaces or evening out potholes 11 for repair. Both impact devices 50, 55 include a body 51, 56 that is movable with respect to the bucket 40 or fixed, such as through bolts or fasteners, with respect to the bucket 40.

The body 51, 56 generally includes a casing and actuating device (not shown) therein for supporting the impact devices 50, 55 and imparting a reciprocating motion to the connected tools 52, 57. Various types of actuating devices common to jackhammers and other reciprocating devices may be utilized with the impact devices 50, 55 as appreciated. The impact devices 50, 55 are generally hydraulically powered through the power of the loader 20. The implement 30 may include various valves and/or pumps (exemplary shown as a valve/pump 60 combination) to direct the hydraulic fluid through hoses 61, 62 to a given impact device 50, 55 as necessitated. The impact devices 50, 55 may be activated independently or collectively.

The tool 52, 57 is connected to the lower end of the body 51, 56 and is preferably removable therefrom, thus allowing the user to interchange various tools. The tools 52, 57 each generally include a shaft 53, 58 with an upper end that is removably connected to the body 51, 56 through the use of a collar or other type of fastening or connecting structure. The lower part of the elongated and linear shaft has a working end 54, 59 for engaging the road surface. The first working end 54 is shown to embody a tampering structure and the second working end 59 is shown to embody a chiseling structure.

It is appreciated that various types of tamper or chisel structures may be utilized. For example, the chisel structure of the second working end 59 may be comprised of a spade bit, a chisel bit, a mole point, etc. The tamper structure of the first working end 54 is generally planar on an impact surface and may vary in surface area to engage a larger or smaller surface and for larger or smaller potholes 11.

E. Shoe.

When it is desired to increase the impacting surface area of first working end 54 without removing the tool 52 from the body 51, a shoe 70 may be fitted to the working end 54, the shoe 70 generally having a much greater sized surface area than the first working end 54. The shoe 70 generally includes a fixed side support 72, an adjustable side support 74, and a lower support 77 forming a retaining cavity 71 for receiving the bottom of the working end 54.

The adjustable side support 74 has an adjustment member 76, generally comprised of a threaded bolt or fastener that adjusts the adjustable side support 74 inwards against the first working end 54 or other part of the first tool 52 to secure the shoe 70 to the first tool 52. The lower support 77 has a greater surface area than the bottom of the first working end 54 and may be used as the tampering structure.

Alternately, a pivotal joint 78 may extend from the lower support 77, such as a rotatable ball joint, and a foot pad 79 having yet a greater surface area than the lower support 77 may extend from the bottom of the pivotal joint 78 thus providing an even greater impacting surface area and a pivotal tampering structure thus being able to impact various angled surfaces of the road and/or pothole 11.

Each of the side supports 33 also generally include an overhang portion 73, 75 to ensure that the working end 54 does not release from the shoe 70 when compacting in the reciprocating motion. The overhang portion 75 of the adjustable side support 74 is preferably angled to allow the working end 54 to slide past the overhang portion 75 to release the working end 54 from the shoe 70 without having to manually adjust the adjustment member 76.

The shoe 70 may also be removed from the first working end 54 without leaving the operator position of the loader 20. To remove the shoe 70 from the cab or operator's seat of the loader 20, downward pressure is applied upon the foot pad 79 to push the foot pad 79 against the ground surface. The bucket 40 is then rolled or pivoted back until the lower support 77 engages the foot pad 79 thus preventing the lower support 77 from pivoting any further.

As the bucket 40 is continued to be rolled or pivoted back, the working end 54 begins to slide upwards along the inwardly angled adjustable side support 74 until the working end 54 finally moves past an inward peak defined as the overhang portion 75 in the adjustable support 74 to release the working end 54 from the shoe 70. The bottom of the foot pad 79, lower support 77, and first working end 54 are comprised of a hard material, member, or plate to withstand excessive pounding upon the road surface. The adjustable side support 74 may also be pivotal to allow easy insertion and removal of the working end 54. A compression material may also be located between the side support 74 and the adjustment member 76.

F. Linkage Assemblies.

In the embodiment illustrated in FIGS. 7 through 9, linkage assemblies 80, 90 are used to movably connect the impact devices 50, 55 between the supporting structure 31 and the bucket 40. It is appreciated that in the embodiment illustrated in FIGS. 12 and 13, the impact devices 50, 55 are fixed between the support plates 36 and the linkage assemblies 80, 90 are not generally used. FIGS. 12 and 13 show one of the support plates 36 partially cutaway; however it is appreciated that the support plates 36 are generally comprised of a similar shape and structure.

The linkage assemblies 80, 90 function in a manner to move the impact devices 50, 55 in a vertically upward and downward manner to move the impact devices 50, 55 to a raised and non use position to a lowered and in-use position. While the impact devices 50, 55 are seated in the lowered in-use position, the impact devices 50, 55 undergo the reciprocating motion. The linkage assemblies 80, 90 are preferably comprised of substantially similar or identical structures and minor each other about a cross-wise center of the bucket 40. The linkage assemblies 80, 90 also preferably operate independently of each other via separately controlled actuators 83, 93. The actuators 83, 93 are generally comprised of hydraulically operated cylinders; however other structures may be appreciated.

Each linkage assembly 80, 90 generally includes a first linking member 81, 91 pivotally connected at a first end to the supporting structure 31 and/or the bucket 40 to be located the space between, a second linking member 82, 92 pivotally connected at a first end to the supporting structure 31 and/or the bucket 40 to be located in the space between, an actuator 83, 93 connecting the first linking member 81, 91 to the second linking member 82, 92, and a carrier 84, 94 pivotally connected at the second ends of the first linking member 81, 91 and the second linking member 82, 92 to vertically move the respective impact device 50, 55.

The actuator 83, 93 is pivotally connected on an upper end to the first end of the first linking member 81, 91 and on a lower end to the second linking member 82, 92 between the first end and the second end. As the actuator 83, 93 retracts, the second linking member 82, 92 is angled upwards to force the first linking member 81, 91 and the second linking member 82, 92 to collectively rotate upwards and move the carrier 84, 94 and attached impact device 50, 55 to a raised position. As the actuator 83, 93 expands, the second linking member 82, 92 is angled downwards to force the first linking member 81, 91 and the second linking member 82, 92 to collectively rotate downwards and move the carrier 84, 94 and attached impact device 50, 55 to a lowered position.

Each carrier 84, 94 also generally includes a catch member 86, 96 extending outwardly from the front or rear of the carrier 84, 94 to engage and become seated within a retaining seat 87, 97 extending into the space between the bucket 40 and the mount 32 of the supporting structure 31. The catch member 86, 96 is received by the retaining seat 87, 97 when the impact devices 50, 55 move to the lowered position. The retaining seat 87, 97 is generally comprised of a semi-circular shaped. The retaining seat 87, 97 helps to stabilize the respective impact device in the lowered position and prevent the impact device from twisting or pivoting while the respective tool 52, 57 undergoes the reciprocating motion.

G. Air Nozzle.

The present invention also may include a nozzle 100 that is supplied air or other fluid from a supply tank 17 generally onboard the trailer 15 or loader 20 via a supply line 18. The nozzle 100 is generally attached to the support assembly 31 directly or through being attached to the bucket 40 to be directed downwards thus being able to spray the road surface, fill material 12, and/or pothole 11. The nozzle 100 is generally fixed in position between the first impact device 50 and the second impact device 55, and in the second embodiment as illustrated in FIGS. 12 and 13, the nozzle 100 is parallel to the second impact device 55.

H. Operation of Preferred Embodiment.

The present invention may be used to repair asphalt or concrete potholes 11. When repairing potholes 11, the operator starts by attaching the implement 30 to the loader 20 via the attachment 22. The implement 30 is placed in a loading mode by moving the first and second impact devices 55 into a retracted or raised position. The bucket 40 is then rotated and filled with the fill material 12 in a convention manner. The operator then rotates the bucket 40 toward an upwardly facing position and raises the implement 30 off of the ground. The second impact device 55 is moved to a lowered position and used to square the pothole 11 via reciprocating the second tool 57.

The second impact device 55 is then raised and the first impact device 50 is moved into the lowered position within the pothole 11 and reciprocates the first tool 52 until the bottom of the pothole 11 becomes flat or until the bottom of the pothole 11 is equal to the depth (or thickness) of the existing layer of asphalt or concrete. The broken apart asphalt or concrete is fractured and leveled within the pothole 11 via the reciprocating tool of the first impact device 50. The operator then positions the lower opening 45 of the bucket 40 over the pothole 11 and opens the gate 47 to selectively release fill material 12. Alternately, a transfer mechanism, such as an auger, may be used to deposit the fill material 12 into the pothole 11 from the bucket 40.

The first impact device 50 is then returned to the pothole 11 and lowered onto the fill material 12 and the first tool 52 reciprocated until the fill material 12 is compacted and covering the entire bottom. The filling and compacting process is continually repeated until the level of the compacted fill material 12 reaches the desired elevation (e.g. level with the surrounding road surface). The fill material 12 may also be leveled with the cutting edge to match the surrounding surface as a final step.

The present invention may also be used in a "no man on the ground" embodiment. The embodiment illustrates the implement 30 attached to an excavator 20 and the excavator 20 positioned upon a flat bed trailer 15 pulled by a dump truck 14 or other vehicle capable of hauling and dumping the fill material 12. The excavator 20 is moved towards the truck 14 having the fill material 12 and the bucket 40 is filled with the fill material 12.

Subsequently the excavator 20 is moved to face the pothole 11 without removing the excavator 20 from the trailer 15. The excavator 20 can subsequently use the implement 30 to repair the pothole 11 from upon the trailer 15. If more fill material 12 is needed, the excavator 20 simply rotates to face the truck 14 to fill the bucket 40. The embodiment illustrates a process of repairing a pothole 11 without an excavator 20 or other loader 20 to be removed from a trailer 15 and thus limiting the number of vehicles needing to drive on a road surface while repairing potholes 11.

It is appreciated that the impact devices 50, 55 are generally fixed to the support assembly 31 of the excavator embodiment shown in FIGS. 12 and 13. Thus to use either impact device, the implement 30 is rotated to a position where the desired impact device 50, 55 to be used is vertically oriented. The air nozzle 100 may also be used to deliver compressed air to the compacted pothole 11 to clean the pothole 11 of the asphalt or concrete fragments.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A loader implement system for repairing potholes, comprising:

a loader, wherein said loader includes a pair of loader arms;

a supporting structure including a mount, wherein a first end of said mount is removably connected to said first loader arm and wherein a second end of said mount is removably connected to said second loader arm;

a first side support extending from said first end of said mount for securing said bucket thereto;

a second side support extending from said second end of said mount for securing said bucket thereto;

a scooping bucket connected to said supporting structure, said bucket having sidewalls defining an upper opening and a lower opening, said sidewalls tapering inwards towards said lower opening;

wherein said bucket includes an actuated gate to close over said lower opening;

a first impact device movably connected to said supporting structure;

said first impact device extends below said bucket, and said first impact device to engage a road surface in a reciprocating manner, wherein said first impact device extends along a first side of said bucket;

said first impact device having an interchangeable tamper end;

a first linkage assembly to connect said first impact device between said bucket and said supporting assembly, said first linkage devices including:

a first linking member;

a second linking member, wherein said second linking member is spaced from said first linking member;

a first actuator interconnecting said first linking member to said second linking member, said first actuator adapted to collectively pivot said first linking member and said second linking member about said support assembly; and a first carrier pivotally connected to said second end of both of said first linking member and said second linking member, said first carrier adapted to support said first impact device in a vertical orientation;

said first actuator adapted to extend and retract to lift and lower said first carrier along with said first impact device to a lower vertical position and an upper vertical position;

wherein said first carrier includes a first catch member and wherein said support assembly includes a first seat, wherein said first catch member is removably received by said first seat to retain said first impact device in said lower vertical position;

wherein said first catch member releases from said first seat when said first impact device is moved to said upper vertical position;

a second impact device connected to said supporting structure, said second impact device extends below said bucket, and said second impact device to engage a road surface in a reciprocating manner, wherein said second impact device extends along a second side of said bucket;

said second impact device having an interchangeable chisel end;

a second linkage assembly to connect said second impact device between said bucket and said supporting assembly, said second linkage devices including:

a third linking member;

a fourth linking member, wherein said third linking member is spaced from said fourth linking member;

a second actuator interconnecting said third linking member to said fourth linking member, said second actuator adapted to collectively pivot said third linking member and said fourth linking member about said support assembly; and a second carrier pivotally connected to said second end of both of said third linking member and said fourth linking member, said second carrier adapted to support said second impact device in a vertical orientation;

said second actuator adapted to extend and retract to lift and lower said second carrier along with said second impact device to a lower vertical position and an upper vertical position;

wherein said second carrier includes a second catch member and wherein said support assembly includes a second seat, wherein said second catch member is removably received by said second seat to retain said second impact device in said lower vertical position;

wherein said second catch member releases from said second seat when said second impact device is moved to said upper vertical position;

wherein said first impact device and said second impact device are each positioned adjacent laterally opposing ends of said bucket;

wherein said first impact device and said second impact device are parallel to each other; and a shoe removably connected to said tamper end of said first impact device, said shoe having an impacting surface area greater than said tamper end;

said shoe having an adjustment member to adjust a size of a retaining cavity adapted to receive said tamper end;

said shoe having a pivotal joint for pivoting said shoe about said tamper end.

* * * * *